US010576705B2

(12) United States Patent
Takeuchi

(10) Patent No.: US 10,576,705 B2
(45) Date of Patent: Mar. 3, 2020

(54) CONTROL SYSTEM, PRESS MACHINE, AND CONTROL METHOD FOR PRESS MACHINE

(71) Applicant: KOMATSU INDUSTRIES CORPORATION, Kanazawa-shi, Ishikawa (JP)

(72) Inventor: Hisanori Takeuchi, Nomi (JP)

(73) Assignee: KOMATSU INDUSTRIES CORPORATION, Ishikawa (JP)

( * ) Notice: Subject to any disclaimer, the term of this patent is extended or adjusted under 35 U.S.C. 154(b) by 412 days.

(21) Appl. No.: 15/329,321

(22) PCT Filed: Jul. 31, 2015

(86) PCT No.: PCT/JP2015/071790

§ 371 (c)(1),
(2) Date: Jan. 26, 2017

(87) PCT Pub. No.: WO2016/027645

PCT Pub. Date: Feb. 25, 2016

(65) Prior Publication Data

US 2017/0217116 A1 Aug. 3, 2017

(30) Foreign Application Priority Data

Aug. 19, 2014 (JP) ..... 2014-166918

(51) Int. Cl.
*B30B 15/28* (2006.01)
*B30B 15/26* (2006.01)
(Continued)

(52) U.S. Cl.
CPC ..... *B30B 15/281* (2013.01); *B30B 15/0094* (2013.01); *B30B 15/148* (2013.01); *B30B 15/26* (2013.01)

(58) Field of Classification Search
CPC ..... B30B 15/15; B30B 15/148; B30B 15/26; B30B 15/0094; B30B 15/281
(Continued)

(56) References Cited

U.S. PATENT DOCUMENTS 4,195,563 A 4/1980 Budraitis et al.
5,701,811 A 12/1997 Kawakami
(Continued)

FOREIGN PATENT DOCUMENTS

CN 1438113 A 8/2003
CN 1853915 A 11/2006
(Continued)

OTHER PUBLICATIONS

The Office Action for the corresponding Chinese application No. 201580038451.7, dated Dec. 1, 2017.
(Continued)

*Primary Examiner* — Matthew Katcoff
(74) *Attorney, Agent, or Firm* — Global IP Counselors, LLP

(57) ABSTRACT

A control system includes a load detector, a determination unit, and a drive control unit. The load detector detects a load of a slide. The load of the slide includes a positive load due to a pressing force of the slide during pressing and a negative load at the time of a breakthrough. The determination unit determines whether to execute emergency stopping of the slide based on the positive load and the negative load detected by the load detector. The drive control unit controls the driving of the slide based on the determination result of the determination unit.

17 Claims, 12 Drawing Sheets

(51) Int. Cl.
*B30B 15/00* (2006.01)
*B30B 15/14* (2006.01)

(58) Field of Classification Search
USPC ... 72/10.4, 10.5, 10.6, 14.3, 14.4, 21.3, 21.4
See application file for complete search history.

(56) References Cited

U.S. PATENT DOCUMENTS

| | | | | |
|---|---|---|---|---|
| 5,732,619 | A * | 3/1998 | Hata | B30B 15/00 100/341 |
| 9,501,052 | B2 * | 11/2016 | Kohno | G05B 19/041 |
| 2003/0116037 | A1 | 6/2003 | Tanaka et al. | |

FOREIGN PATENT DOCUMENTS

| | | | |
|---|---|---|---|
| CN | 101808814 | A | 8/2010 |
| EP | 2 703 151 | A1 | 3/2014 |
| JP | 59-118298 | A | 7/1984 |
| JP | 2-47000 | A | 2/1990 |
| JP | 4-55100 | A | 2/1992 |
| JP | 4-84700 | A | 3/1992 |
| JP | 7-117668 | A | 5/1995 |
| JP | 7-251300 | A | 10/1995 |
| JP | 8-174300 | A | 7/1996 |
| JP | 11-226798 | A | 8/1999 |
| JP | 2000-246498 | A | 9/2000 |
| JP | 2004-58152 | A | 2/2004 |
| JP | 2006-15398 | A | 1/2006 |
| KR | 10-2006-0117547 | A | 11/2006 |
| KR | 10-0745526 | B1 | 7/2007 |

OTHER PUBLICATIONS

International Search Report for the corresponding international application No. PCT/JP2015/071790, dated Oct. 27, 2015.
The Office Action for the corresponding Japanese application No. 2018-150711, dated Apr. 16, 2019.

* cited by examiner

| | | |
|---|---|---|
| STEP 1 | TARGET PRESS ANGLE [deg.] | 172 |
| | TARGET POSITION [mm] | 1.02 |
| | SPEED [%] | 100 |
| | STOPPAGE TIME PERIOD [s] | 0.1 |
| STEP 2 | TARGET PRESS ANGLE [deg.] | 180 |
| | TARGET POSITION [mm] | 0 |
| | SPEED [%] | 70 |
| | STOPPAGE TIME PERIOD [s] | 0 |
| RETURN | SPEED [%] | 100 |
| | STOPPAGE TIME PERIOD [s] | 0 |

CONTROL SYSTEM, PRESS MACHINE, AND CONTROL METHOD FOR PRESS MACHINE

CROSS-REFERENCE TO RELATED APPLICATIONS

This application is a U.S. National stage application of International Application No. PCT/JP2015/071790, filed on Jul. 31, 2015. This U.S. National stage application claims priority under 35 U.S.C. § 119(a) to Japanese Patent Application No. 2014-166918, filed in Japan on Aug. 19, 2014, the entire contents of which are hereby incorporated herein by reference.

BACKGROUND

Field of the Invention

The present invention relates to a control system for a press machine. The control system is provided in a press machine which raises and lowers a slide to perform pressing and the control system controls the driving of the slide. The present invention further relates to a press machine provided with the control system. The present invention also relates to a control method for a press machine.

Background Information

A press machine includes a slide, which is supported on a main body frame in a manner that allows the slide to move up and down, and includes an upper die mounted on the bottom surface of the slide. Moreover, a bolster is disposed below the slide, and a lower die which faces the upper die is mounted on the top surface of the bolster. The slide is raised and lowered by a drive mechanism provided with an electric motor and a mechanism for converting the rotation of the electric motor to up and down motions. Pressing is carried out on this type of pressing machine by setting a workpiece on the lower die, lowering the slide and pressing the upper die onto the workpiece.

There is a concern that components, such as the dies, may be damaged if the pressing force from the slide during the pressing is excessive. Alternatively, defects occur more easily if the pressing force from the slide is excessive. As a result, the amount of the pressing force from the slide is detected in order to prevent the pressing force from the slide from becoming excessive in Japanese Patent Laid-open No. 2000-246498, for example.

SUMMARY

At the moment that the upper die punches out the workpiece during pressing, a phenomenon occurs in which the pressing force of the slide up to that moment is released and the upper die is drawn downward. This phenomenon is called "breakthrough." When the pressing force is a positive load, a negative load occurs in the slide at the moment of the breakthrough.

This negative load as well as the positive load from the above-mentioned pressing force of the slide may be factors in the cause of abnormalities, such as damage to components or the occurrence of defects. Alternatively, the negative load from the breakthrough may lead to noise and vibrations. However, it is difficult to properly detect the negative load at the time of the breakthrough and suppress the occurrence of defects when only the pressing force of the slide is detected as discussed above.

An object of the present invention is to provide a control system, a press machine, and a control method for a press machine that are able to suppress the occurrence of abnormalities due to the negative load at the time of the breakthrough.

A control system according to a first aspect of the present invention is a system for controlling a press machine which raises and lowers a slide to perform pressing. The control system includes a load detector, a determination unit, and a drive control unit. The load detector detects the load of the slide. The load of the slide includes a positive load due to the pressing force of the slide during pressing and a negative load at the time of a breakthrough. The determination unit determines whether to execute an emergency stop of the slide on the basis of the positive load and the negative load detected by the load detector. The drive control unit controls the driving of the slide on the basis of the determination result of the determination unit.

A load including the negative load at the time of the breakthrough is detected in addition to a positive load from the pressing force of the slide during the pressing in the control system according to the present aspect. A determination is made to execute the emergency stop of the slide on the basis of the positive load and the negative load. As a result, the occurrence of abnormalities brought about by the negative load at the time of the breakthrough can be suppressed.

The determination unit may perform an overload determination. The determination unit may determine whether to execute the emergency stop when the maximum value of the positive load is greater than a predetermined first overload determination value in the overload determination. In this case, the occurrence of abnormalities brought about by an excessive positive load can be suppressed.

The determination unit may determine whether to execute the emergency stop when an absolute value of the minimum value of the negative load is greater than a predetermined second overload determination value in the overload determination. In this case, the occurrence of abnormalities brought about by an excessive absolute value of the negative load can be suppressed.

The determination unit may determine whether to execute the emergency stop when a difference between the maximum value of the positive load and the minimum value of the negative load is greater than a predetermined third overload determination value in the overload determination. In this case, the occurrence of abnormalities brought about by an excessive difference between the positive load and the negative load can be suppressed.

The drive control unit may promptly stop the slide when the determination unit determines to execute the emergency stop in the overload determination. In this case, the occurrence of abnormalities can be stopped quickly. In particular, there is a concern that components may become damaged when the amount of the loads becomes excessive. Therefore, damage to the press machine can be prevented by quickly stopping the slide when the amount of the loads is excessive.

The determination unit may perform a load lower limit determination. The determination unit may determine whether to execute the emergency stop when the maximum value of the positive load is less than a predetermined first lower limit determination value in the load lower limit determination. In this case, the occurrence of abnormalities brought about by a positive load that is too small can be suppressed.

The determination unit may determine whether to execute the emergency stop when an absolute value of the minimum value of the negative load is less than an absolute value of a predetermined second lower limit determination value in the load lower limit determination. In this case, the occurrence of abnormalities brought about when the absolute value of the negative load is too small can be suppressed.

The determination unit may determine whether to execute the emergency stop when a difference between the maximum value of the positive load and the minimum value of the negative load is less than a predetermined third lower limit determination value in the load lower limit determination. In this case, the occurrence of abnormalities brought about by the difference between the positive load and the negative load being too small can be suppressed.

The drive control unit may move the slide to a predetermined standby position and stop the slide when the determination unit determines to execute the emergency stop in the load lower limit determination. In this case, the work can be quickly restarted after inspecting for the presence or absence of an abnormality. In particular, the components are less likely to become damaged when the amount of the loads is too small. Therefore, a decrease in productivity can be suppressed by stopping the slide after moving the slide to the predetermined standby position instead of merely immediately stopping the slide when the amount of the loads is too small.

The control system may further include a display for displaying the positive load and the negative load detected by the load detector. In this case, an operator can easily learn that a negative load has occurred at the time of a breakthrough.

The load detector may detect the left and right loads of the slide. The display may display the left and right loads and the total load of the left and right loads. In this case, the display displays the left and right loads and the total load of the left and right loads respectively for the positive load and the negative load. As a result, the operator is able to see more precisely the load of the slide.

The display may display a waveform indicating changes in the loads of the slide including the positive load and the negative load. In this case, the operator is able to easily see any changes in the loads of the slide at the time of pressing the workpiece and at the time of the breakthrough.

The control system may further include a motion setting unit for setting a target position of the slide, the speed of the slide, and a stoppage time of the slide at the target position. In this case, the occurrence of abnormalities at the time of the breakthrough can be suppressed by the operator using the motion setting unit to optionally set the target position, the speed, and the stoppage time of the slide.

The determination unit may determine whether to execute the emergency stop by using a corrected load when the load detected by the load detector is a negative load. In this case, the determination of the emergency stop can be detected for precisely by using a corrected detection value of the loads even when detecting the positive load is proper but the precision for detecting the negative load is low as a sensor provided in a conventional press machine.

A press machine according to a second aspect of the present invention includes a main body frame, a slide, a drive mechanism and the above-mentioned control system. The slide is supported on the main body frame in a manner that allows up and down movement. The drive mechanism raises and lowers the slide.

A load including the negative load at the time of a breakthrough is detected in addition to a positive load from the pressing force of the slide during the pressing in the press machine according to the present aspect. A determination is made to execute the emergency stop of the slide on the basis of the positive load and the negative load. As a result, the occurrence of abnormalities brought about by the negative load at the time of the breakthrough can be suppressed.

A control method for a press machine according to a third aspect of the present invention is a control method for a press machine which performs pressing by raising and lowering a slide. The control method according to the present aspect includes a load detection step, a determination step, and a drive control step. The load of the slide including a positive load of the slide during pressing and a negative load at the time of a breakthrough is detected in the load detection step. A determination whether to execute an emergency stop of the slide is made in the determination step on the basis of the positive load and the negative load detected in the load detection step. The driving of the slide is controlled in the drive control step on the basis of the determination result from the determination step.

A load including the negative load at the time of a breakthrough is detected in addition to a positive load from the pressing force of the slide during the pressing in the control method of the press machine according to the present aspect. A determination is made to execute the emergency stop of the slide on the basis of the positive load and the negative load. As a result, the occurrence of abnormalities brought about by the negative load at the time of the breakthrough can be suppressed.

According to exemplary embodiments of the present invention, the occurrence of abnormalities brought about by the negative load at the time of the breakthrough can be suppressed.

DESCRIPTION OF EXEMPLARY EMBODIMENTS

Figure 1:
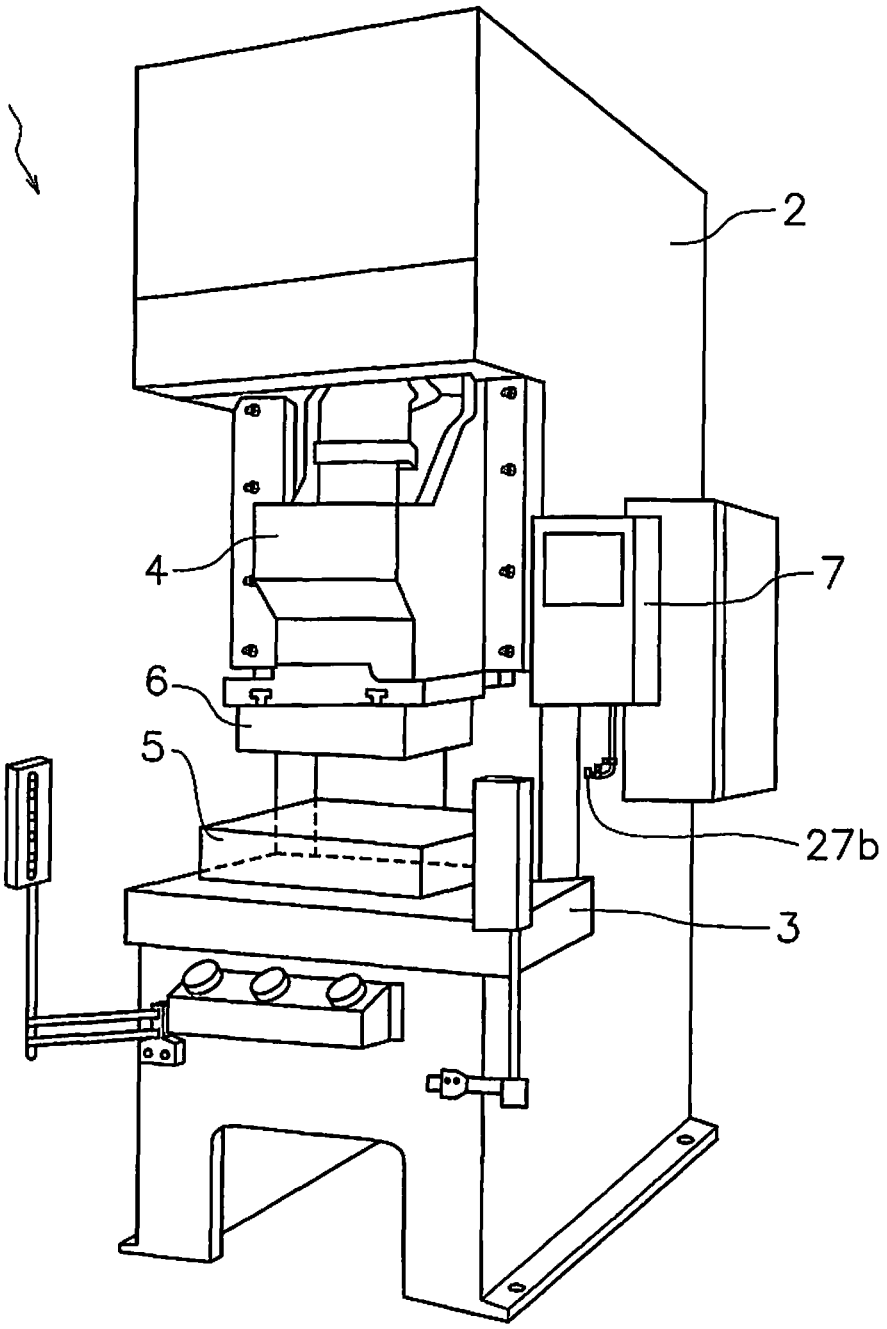
FIG. 1 is an external perspective view of a press machine according to an exemplary embodiment.

A press machine according to the exemplary embodiments will be discussed below with reference to the drawings. FIG. 1 is a perspective view of a press machine 1 according to the present exemplary embodiment.

As illustrated in FIG. 1, the press machine 1 includes a main body frame 2, a bolster 3, and a slide 4. The main body frame 2 has a C-shape as seen in a side view. The bolster 3 is disposed in a lower portion of the main body frame 2. A lower die 5 is mounted on the upper surface of the bolster 3. The slide 4 is supported in an upper portion of the main body frame 2 in a manner that allows up and down movement. An upper die 6 is mounted on the lower surface of the slide 4 so as to face a lower die 5. In the present exemplary embodiment, the left and right directions refer to the direction to the left and right as seen from an operator standing in front of and facing the lower die 5 and the upper die 6.

The press machine 1 includes a display input device 7. The display input device 7 is, for example, a touch panel-type display. The display input device 7 displays information pertaining to the press machine 1. Moreover, the display input device 7 is operated in order to input settings of the press machine 1.

Figure 2:
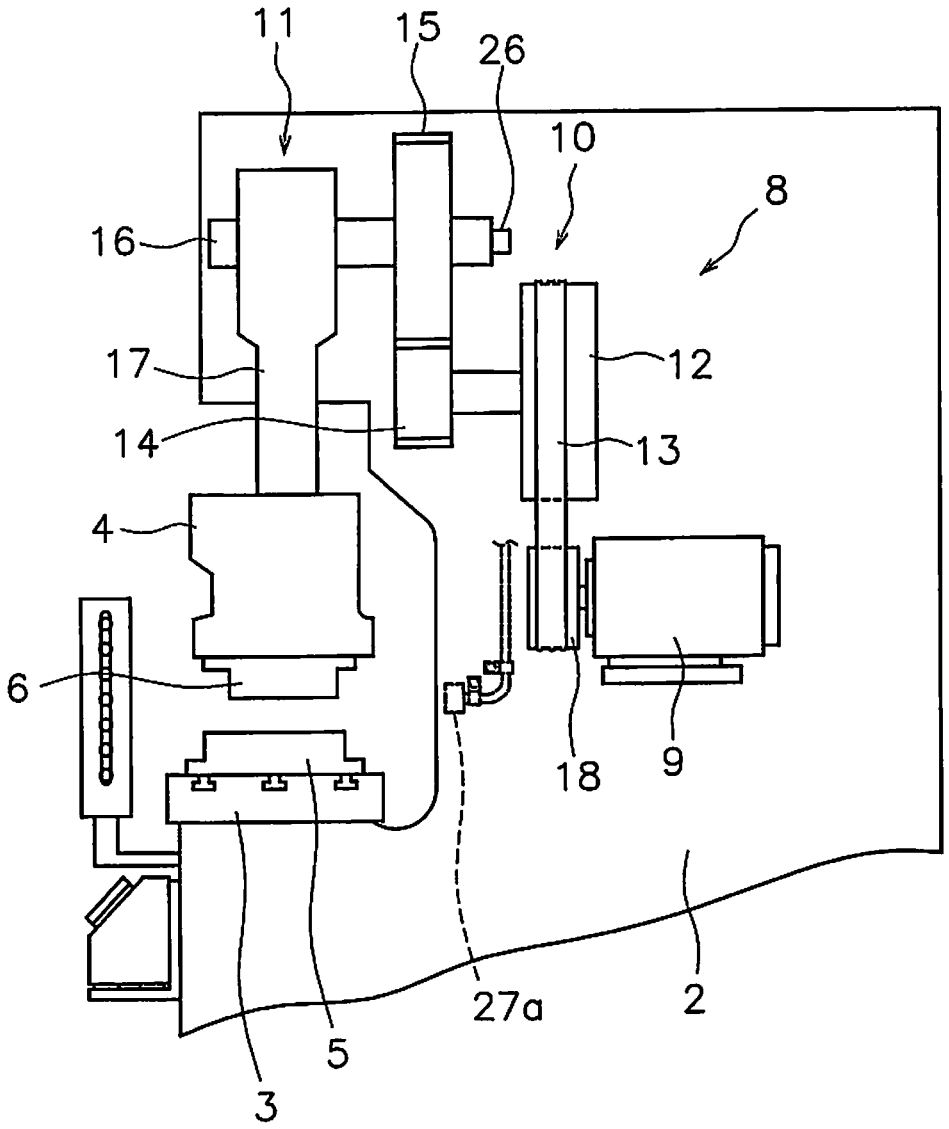
FIG. 2 is a partial cross-section view of the press machine.

FIG. 2 is side view of principal parts of the press machine 1. As illustrated in FIG. 2, the press machine 1 includes a drive mechanism 8. The drive mechanism 8 is provided on the main body frame 2. The drive mechanism 8 raises and lowers the slide 4. Specifically, the drive mechanism 8 includes a servomotor 9, a power transmission mechanism 10, and an action conversion mechanism 11.

The power transmission mechanism 10 includes a second pulley 12, a belt member 13, a first gear 14, and a second gear 15. The second pulley 12 is coupled via the belt member 13 to a pulley 18 fixed to an output shaft of the servomotor 9. The first gear 14 is coupled to the second pulley 12. The first gear 14 is disposed coaxially with the second pulley 12. The second gear 15 meshes with the first gear 14.

The action conversion mechanism 11 converts the rotation of the servomotor 9 to the raising and lowering of the slide 4. Specifically, the action conversion mechanism 11 includes a crankshaft 16 and a connecting rod 17. The crankshaft 16 is coupled to the second gear 15. The crankshaft 16 is disposed coaxially with the second gear 15. The upper end portion of the connecting rod 17 is rotatably mounted on an eccentric portion of the crankshaft 16. The slide 4 is rotatably mounted to the lower end portion of the connecting rod 17.

Figure 3:
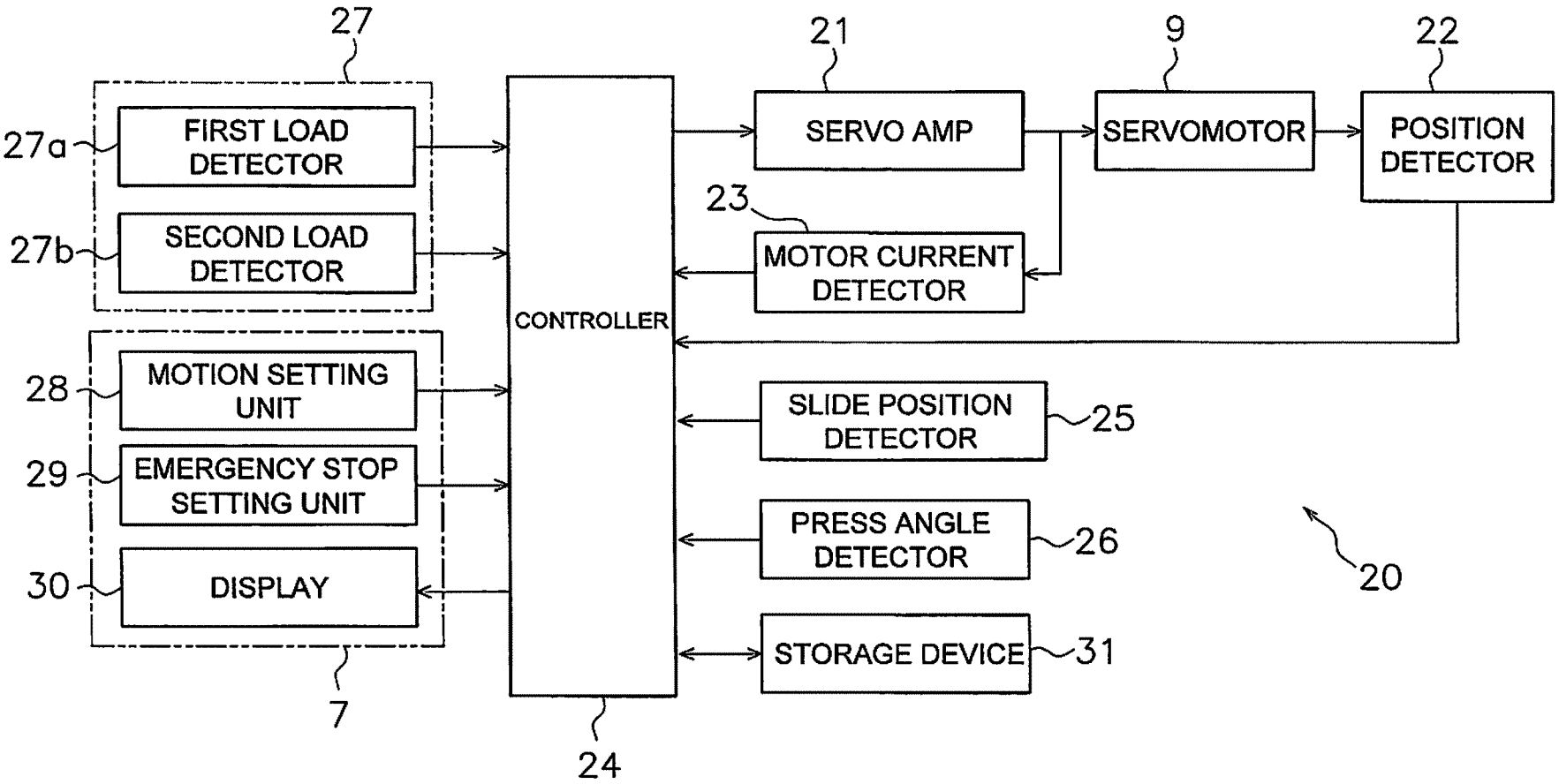
FIG. 3 is a block diagram illustrating a control system of the press machine.

FIG. 3 is a block diagram illustrating a configuration of a control system 20 of the press machine 1. The control system 20 includes a servo amp 21, a position detector 22, and a motor current detector 23. The above-mentioned servomotor 9 is an electric motor and the servo amp 21 is an amplifier for controlling the driving current of the servomotor 9. The position detector 22 detects the rotation angle of the servomotor 9. The motor current detector 23 detects the driving current of the servomotor 9.

The control system 20 includes a controller 24. A detection signal from the position detector 22 which indicates the rotation angle of the servomotor 9 is input into the controller 24. A detection signal from the motor current detector 23, which indicates the driving current of the servomotor 9, is input into the controller 24. The position detector 22 is, for example, an encoder attached to the rotating shaft of the servomotor 9.

The control system 20 includes a slide position detector 25. The slide position detector 25 detects the height position of the slide 4 from the bolster 3. The slide position detector 25 is, for example, a linear sensor. A detection signal from the slide position detector 25, which indicates the slide position, is input into the controller 24.

The control system 20 includes a press angle detector 26. The press angle detector 26 detects the rotation angle (referred to hereinbelow as "press angle") of the crankshaft 16. The press angle detector 26 is, for example, an encoder attached to the crankshaft 16. A detection signal from the press angle detector 26, which indicates the press angle, is input into the controller 24.

The control system 20 includes a load detector 27. The load detector 27 detects a load (referred to hereinbelow as "slide load") acting on the slide 4. Specifically, the load detector 27 includes a first load detector **27*a* and a second load detector 27*b*. The slide load includes a positive load due to the pressing force of the slide 4 during pressing and a negative load at the time of a breakthrough in the following discussion. The first load detector 27*a* detects a load on a left side portion of the slide 4 (referred to hereinbelow as "slide left load") and the second load detector 27*b* detects a load on a right side portion of the slide 4 (referred to hereinbelow as "slide right load") in the present exemplary embodiment. However, the first load detector 27*a* may detect the slide right load and the second load detector 27*b*** may detect the slide left load.

The first load detector **27*a* and the second load detector 27*b* are, for example, strain gauges. As illustrated in FIG. 2, the first load detector 27*a* is attached to the left side portion of the main body frame 2. As illustrated in FIG. 1, the second load detector 27*b* is attached to the right side portion of the main body frame 2. A detection signal from the first load detector 27*a* which indicates the slide left load is input into the controller 24. A detection signal from the second load detector 27*b*, which indicates the slide right load, is input into the controller 24**.

Figures 4, 5:
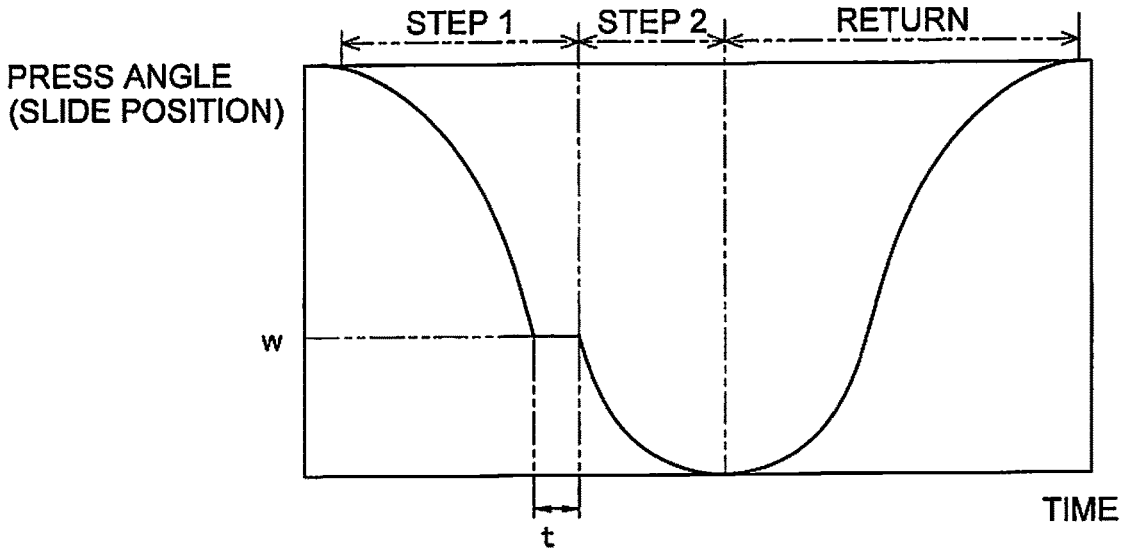
FIG. 4 is a view illustrating an example of motion data.
FIG. 5 is a view illustrating changes in the pressing angle during one cycle of pressing.

The control system 20 includes a motion setting unit 28. The motion setting unit 28 is a device for setting motion data, which represent the slide motions. FIG. 4 is a view illustrating an example of the motion data. As illustrated in FIG. 4, the motion data includes a target press angle, a target position of the slide 4, the speed of the slide 4, and a stoppage time period of the slide 4 at the target position. The motion data is set for each step of the pressing.

FIG. 5 is a view illustrating changes in the pressing angle during one cycle of pressing. The changes in the press angle correspond to changes in the slide position. One cycle represents the slide 4 moving from the top dead center to the bottom dead center and returning to the top dead center again. A step 1, a step 2, and a return step are included in one cycle. In the step 1, the slide 4 moves from the top dead center to a position w immediately before the upper die 6 punches out the workpiece. As illustrated in FIG. 5, the upper die 6 stops for a time period t at the position w immediately before the upper die 6 punches out the workpiece, whereby vibration or noise during the breakthrough can be reduced.

In step 2, the slide 4 moves from the position w immediately before the upper die 6 punches through the workpiece, to the bottom dead center. In the return step, the slide 4 moves from the bottom dead center back to the top dead center.

The operator is able to optionally set the parameters included in the motion data by using the motion setting unit 28. The motion data set with the motion setting unit 28 is input into the controller 24.

As illustrated in FIG. 3, the control system 20 includes an emergency stop setting unit 29. The emergency stop setting unit 29 is used for setting various types of determination data used in a below-mentioned emergency stop determination. The determination data set with the emergency stop setting unit 29 is input into the controller 24.

The control system 20 includes a display 30. The display 30 displays, on the basis of command signals from the controller 24, various types of data measured by the controller 24 during pressing. The display 30, the motion setting unit 28, and the emergency stop setting unit 29 are included in the above-mentioned display input device 7. In the present exemplary embodiment, the motion setting unit 28 and the emergency stop setting unit 29 are configured by software keys displayed on the touch panel.

The control system 20 includes a storage device 31. The storage device 31 stores the motion data set with the motion setting unit 28 and the determination data set with the emergency stop setting unit 29. Moreover, the storage device 31 stores molding data. The molding data includes the slide position detected by the slide position detector 25 and the press angle detected by the press angle detector 26. Furthermore, the molding data includes the slide loads detected by the first load detector 27*a* and the second load detector 27*b*. The storage device 31 is configured, for example, by a semiconductor memory or a storage device, such as a hard disk device.

The controller 24 is configured mainly by a computer device, such as a microcomputer and the like. The controller 24 carries out predetermined arithmetic operations, such as feedback control and the like, on the basis of the above-mentioned motion data and the detection values from the above-mentioned detectors, and computes command values for the servomotor 9. The controller 24 outputs command signals, which indicate the computed command values, to the servo amp 21 and controls the slide 4.

The controller 24 generates the molding data by measuring the slide position, the press angle, and the slide load at predetermined sampling cycle time periods, and by recording the data in the storage device 31 chronologically. The sampling cycle time period is 1 ms for example. However, the sampling cycle time period may be set optionally. The controller 24 carries out data display processing by causing the display 30 to display the molding data recorded in the storage device 31. Furthermore, the controller 24 carries out the emergency stop determination to determine the execution of an emergency stop on the basis of the slide load detected by the first load detector 27*a* and the second load detector 27*b*. The data display processing and the emergency stop determination processing carried out by the controller 24 will be discussed below.

Figure 6:
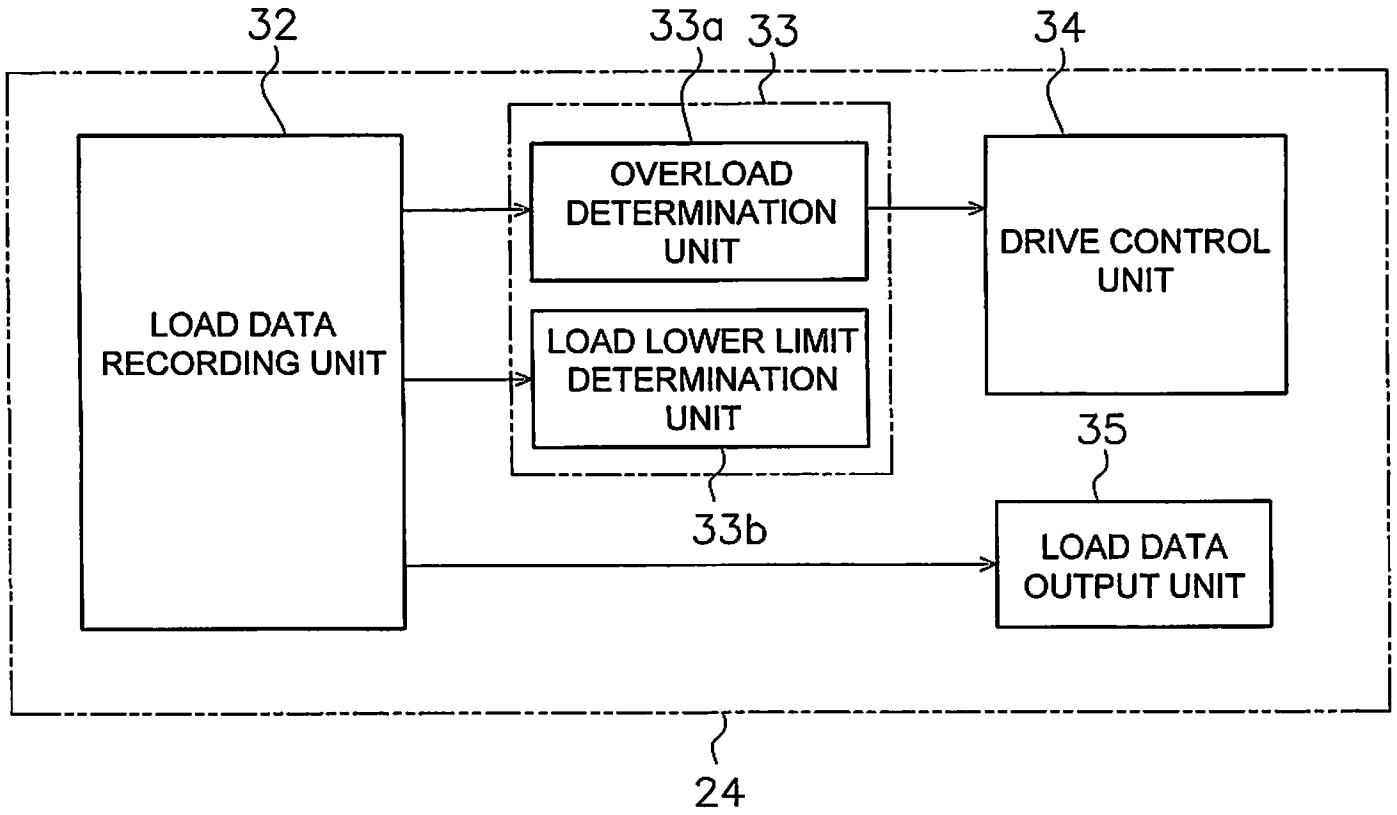
FIG. 6 is a functional block diagram indicating functions executed by a controller.

FIG. 6 is a functional block diagram indicating functions executed by the controller 24. As illustrated in FIG. 6, the controller 24 includes a load data recording unit 32, a determination unit 33, a drive control unit 34, and a load data output unit 35. The load data recording unit 32 detects the slide load during each predetermined sampling cycle time period and records the slide load chronologically in the storage device 31. As a result, the load data recording unit 32 generates the load data.

The determination unit 33 carries out the emergency stop determination on the basis of the detected slide loads. Specifically, the determination unit 33 includes an overload determination unit 33*a* and a load lower limit determination unit 33*b*. The overload determination unit 33*a* determines the execution of the emergency stop by comparing the detected slide loads with predetermined overload determination values. The load lower limit determination unit 33*b* determines the execution of the emergency stop by comparing the detected slide loads with predetermined lower limit determination values.

The drive control unit 34 controls the driving of the slide 4 on the basis of the determination results of the determination unit 33. The drive control unit 34 controls the driving of the slide 4 by outputting command signals to the servomotor 9. When the determination unit 33 decides that the emergency stop is to be executed, the drive control unit 34 stops the slide 4.

The load data output unit 35 displays, on the display 30, the load data recorded in the storage device 31 by the load data recording unit 32. The load data output unit 35 displays the load data on the display 30 by outputting command signals to the display 30. The load data output unit 35 may output the load data to an external control device or recording medium and the like, and is not limited to displaying the load data on the display 30.

Figure 7:
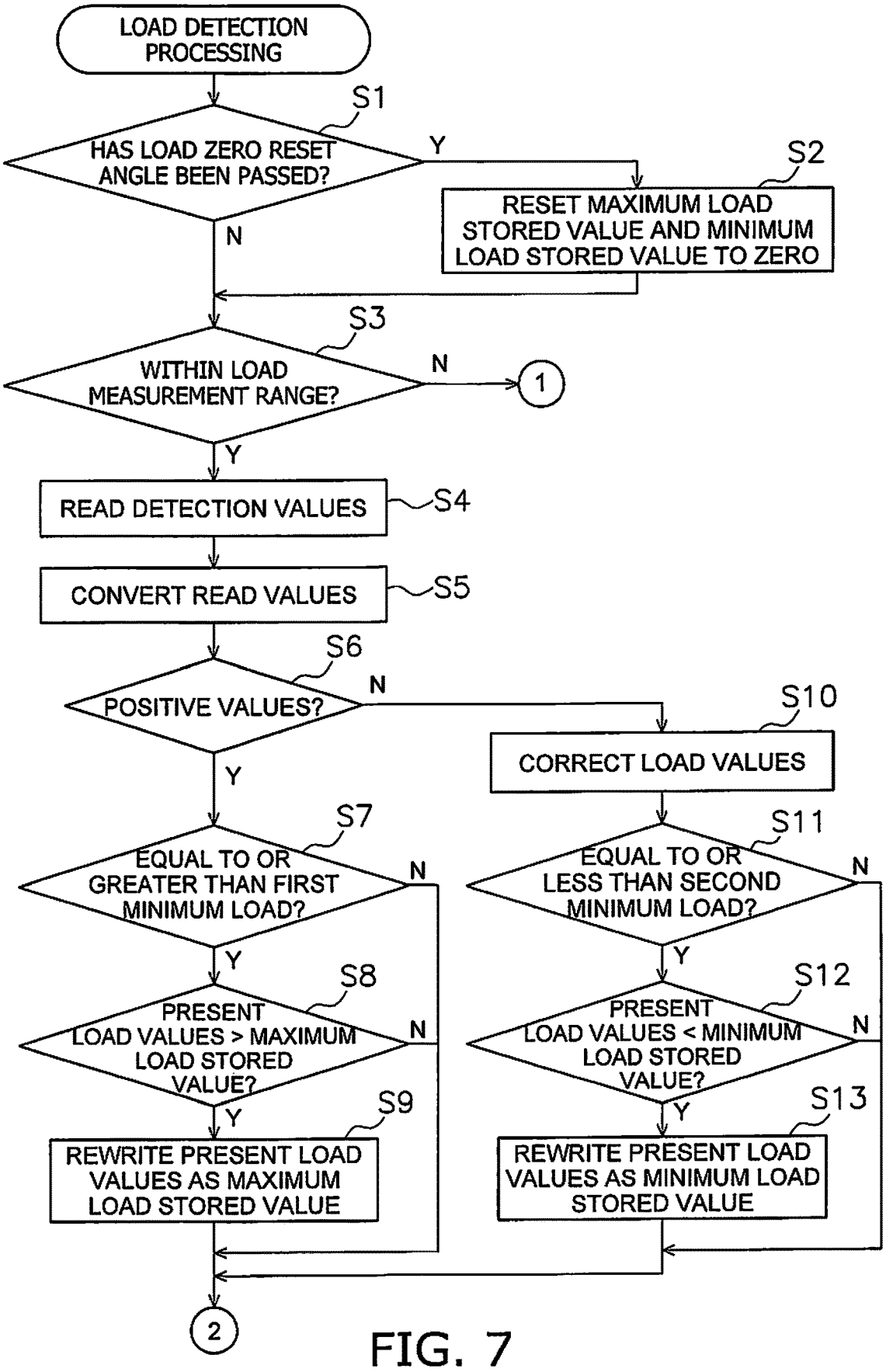
FIG. 7 is a flow chart illustrating processing for detecting load data.

FIG. 7 is a flow chart illustrating processing for detecting the slide loads, and the processing is mainly executed by the load data recording unit 32. In step S1, a determination is made as to whether the press angle has passed through a load zero reset angle. The load zero reset angle is set as a value that indicates that the slide 4 has finished the pressing in one cycle and has returned to the top dead center. Therefore, the load zero reset angle is a value near 0 degrees and is, for example, an angle of approximately 15 degrees. However, the load zero reset angle may be another value.

When the press angle has passed through the load zero reset angle, the process advances to step S2. In step S2, a maximum load stored value and a minimum load stored value are reset to zero. That is, the maximum load stored value and the minimum load stored value are reset for each cycle. If the press angle has not passed through the load zero reset angle, the process skips step S2 and advances to step S3.

In step S3, a determination is made as to whether the press angle is within a load measurement range. The load measurement range is set as a range of press angles for measuring the slide loads within one cycle. The load measurement range preferably includes a range within which the slide loads fluctuate including before and after the punching out. The load measurement range is, for example, 100 degrees to 250 degrees, but may also be a different range. If the press angle is within the load measurement range, the process advances to step S4. If the press angle is not within the load measurement range, the slide load is not recorded.

In step S4, the detection values of the slide loads are read. The load data recording unit 32 reads the detection signals detected by the first load detector 27*a* and the second load detector 27*b*.

In step S5, the read values are converted. The load data recording unit 32 converts the values of the detection signals read in step S4 to slide loads.

In step S6, a determination is made as to whether the slide loads are positive values. The slide loads being positive values signifies that the slide 4 is pressing the workpiece. When the slide loads are positive values, the process advances to step S7.

In step S7, a determination is made as to whether the latest slide loads (referred to hereinbelow as "present slide loads") read in step S4 are equal to or greater than a predetermined first minimum load. The predetermined first minimum load is a positive value. When the present slide loads are equal to or greater than the first minimum load, the process advances to step S8.

In step S8, a determination is made as to whether the present slide loads are greater than the maximum load stored value stored in the storage device 31. When the present slide loads are greater than the maximum load stored value, the process advances to step S9. In step S9, the present slide loads are rewritten and recorded in the storage device 31 as the maximum load stored value. That is, the maximum load stored value stored in the storage device 31 is updated to the value of the present slide loads in step S9.

When the present slide loads in step S7 are not equal to or greater than the predetermined first minimum load, the process skips steps S8 and S9. That is, if the slide loads are smaller than the predetermined first minimum load and are values near zero, the slide loads are ignored and the maximum load stored value is not rewritten.

Figure 8:
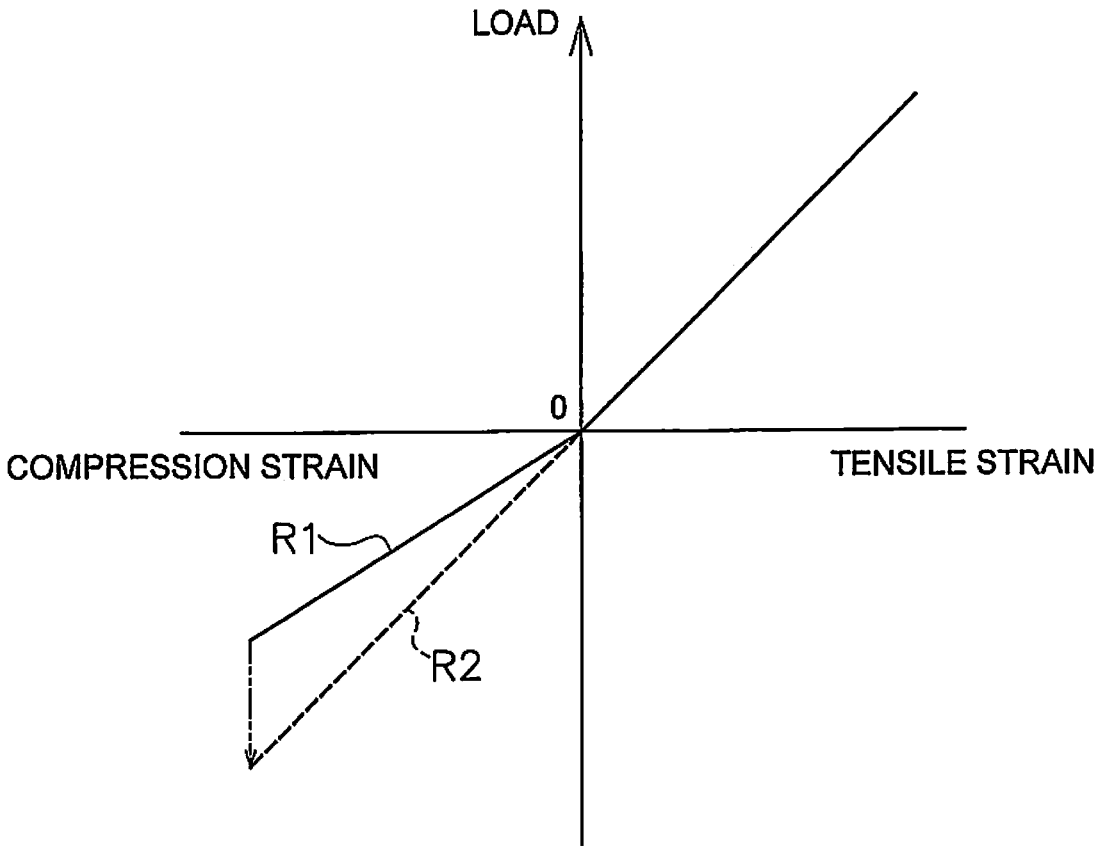
FIG. 8 is a graph illustrating strain and load characteristics from first and second load detectors.

When the slide loads are a negative value in step S6, the process advances to step S10. In step S10, the slide loads are corrected. FIG. 8 is a graph illustrating strain and load characteristics from the first and second load detectors 27*a* and 27*b* used in the present exemplary embodiment. Tensile strain generates a positive load. Compressive strain generates a negative load. While the positive load and the tensile strain are accurately treated by the first and second detectors 27*a* and 27*b* used in the present exemplary embodiment, inaccuracies are present in the treatment of the negative load and the compressive strain. In step S10, in order to correct a treatment R1 of the negative load and the compressive strain that have inaccuracies to a treatment R2 of an optimum negative load and compressive strain, the slide load is multiplied by a predetermined correction coefficient.

In step S11, a determination is made as to whether the present slide loads are equal to or less than a predetermined second minimum load. The predetermined second minimum load is a negative value. When the present slide loads are equal to or less than the second minimum load, the process advances to S12.

In step S12, a determination is made as to whether the present slide loads are less than the minimum load stored value stored in the storage device 31. When the present slide loads are less than the minimum load stored value, the process advances to step S13. In step S13, the present slide loads are rewritten and recorded in the storage device 31 as the minimum load stored value. That is, the minimum load stored value stored in the storage device 31 is updated to the value of the present slide loads in step S13.

When the present slide loads in step S11 are not equal to or less than the predetermined second minimum load, the process skips steps S12 and S13. That is, when the slide loads are a value greater than the predetermined second minimum load and near zero, the slide loads are ignored and the minimum load stored value is not rewritten.

Figure 9:
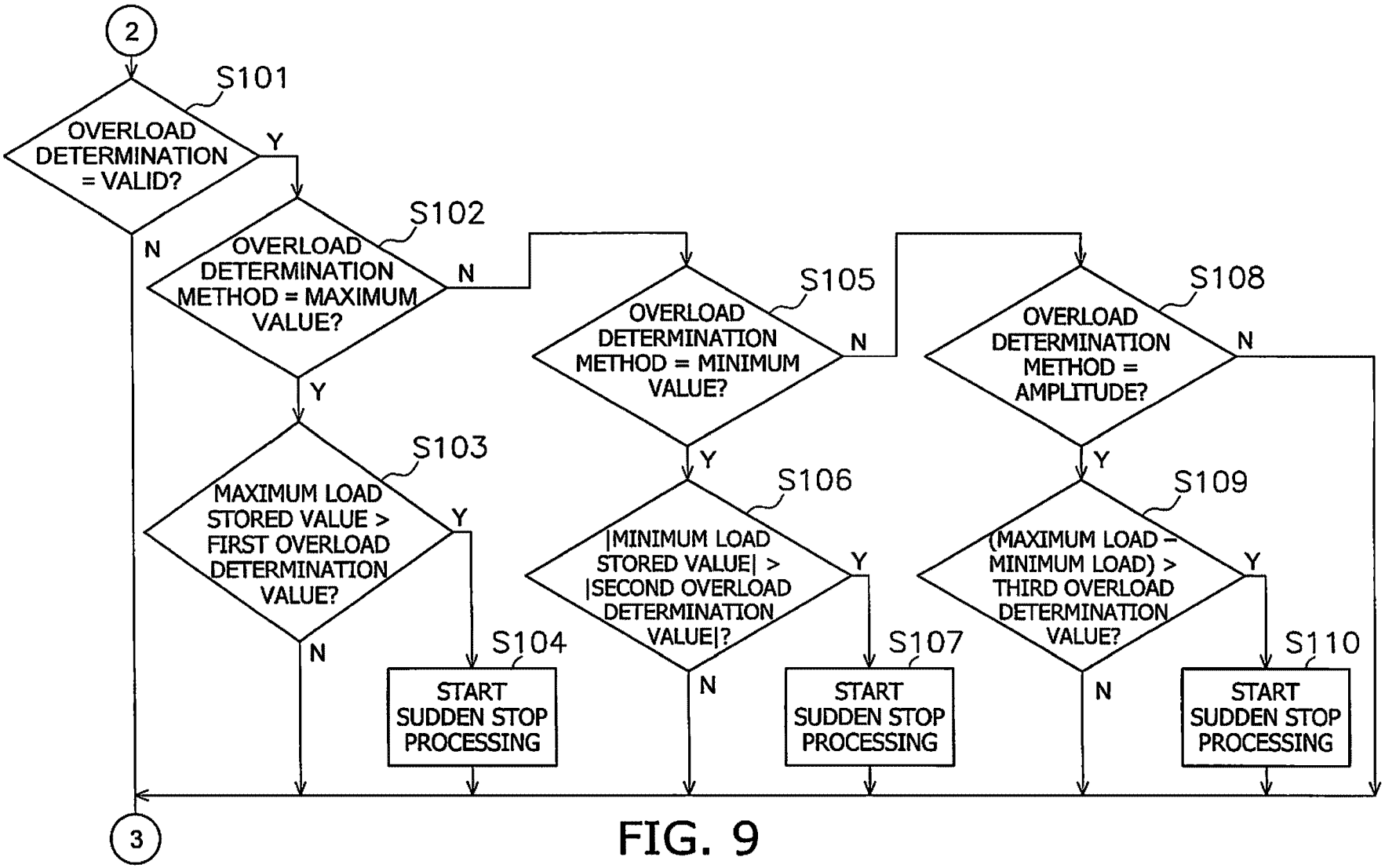
FIG. 9 is a flow chart illustrating overload determination processing.

FIG. 9 is a flow chart illustrating overload determination processing and the processing is mainly carried out by the overload determination unit 33*a*. In step S101, a determination is made as to whether the overload determination is valid or not. The operator is able to optionally set the overload determination to valid or invalid with the above-mentioned emergency stop setting unit 29. When the overload determination is set to valid, the process advances to step S102. When the overload determination is set to invalid, the process advances to the below-mentioned load lower limit determination processing (see FIG. 12).

In step S102, a determination is made as to whether the maximum value is selected as the overload determination method. When the maximum value is selected as the overload determination method, the process advances to step S103. In step S103, a determination is made as to whether the above-mentioned maximum load stored value is greater than a predetermined first overload determination value. When the maximum load stored value is greater than the predetermined first overload determination value, the process advances to step S104. Sudden stop processing is started in step S104. When the maximum load stored value is not greater than the predetermined first overload determination value, the process advances to the below-mentioned load lower limit determination processing.

Figure 10:
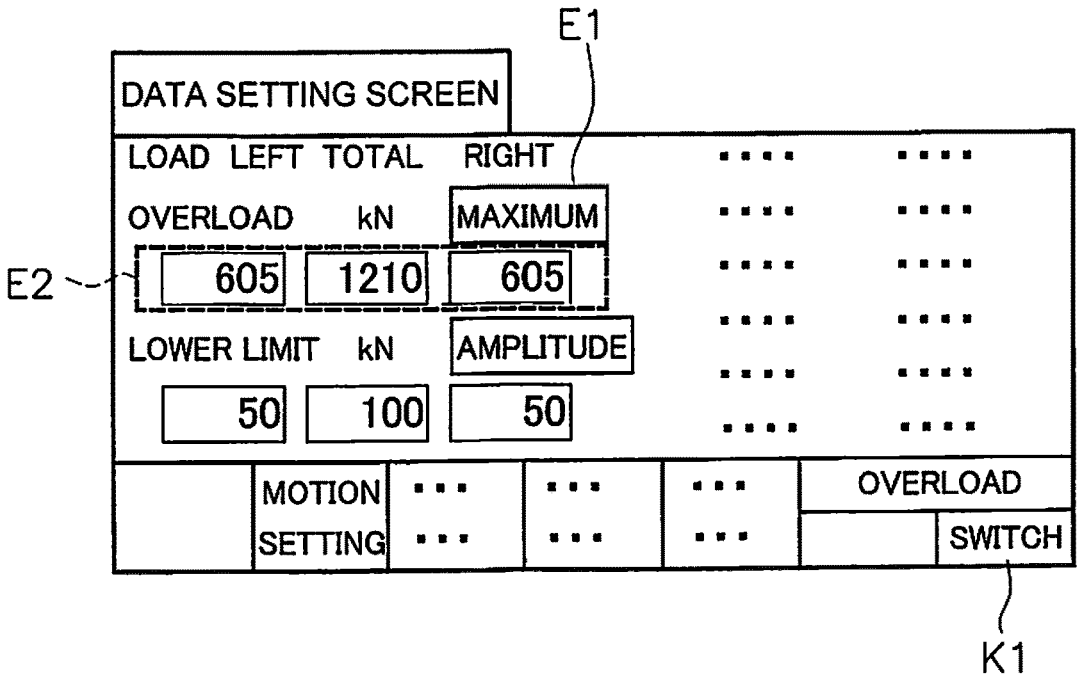
FIG. 10 illustrates an example of a setting screen for inputting determination data for overload determination.

FIG. 10 illustrates an example of a setting screen for inputting determination data for the overload determination with the emergency stop setting unit 29. As illustrated in FIG. 10, the setting screen includes an overload determination method selection field E1. The operator is able to select "maximum value," "minimum value," or "amplitude" as the overload determination method with the emergency stop setting unit 29. Specifically, the operator can switch between the overload determination methods to be selected in the selection field in order from "maximum value" to "minimum value" to "amplitude" by pressing a switch key K1 on the setting screen.

Figure 11:
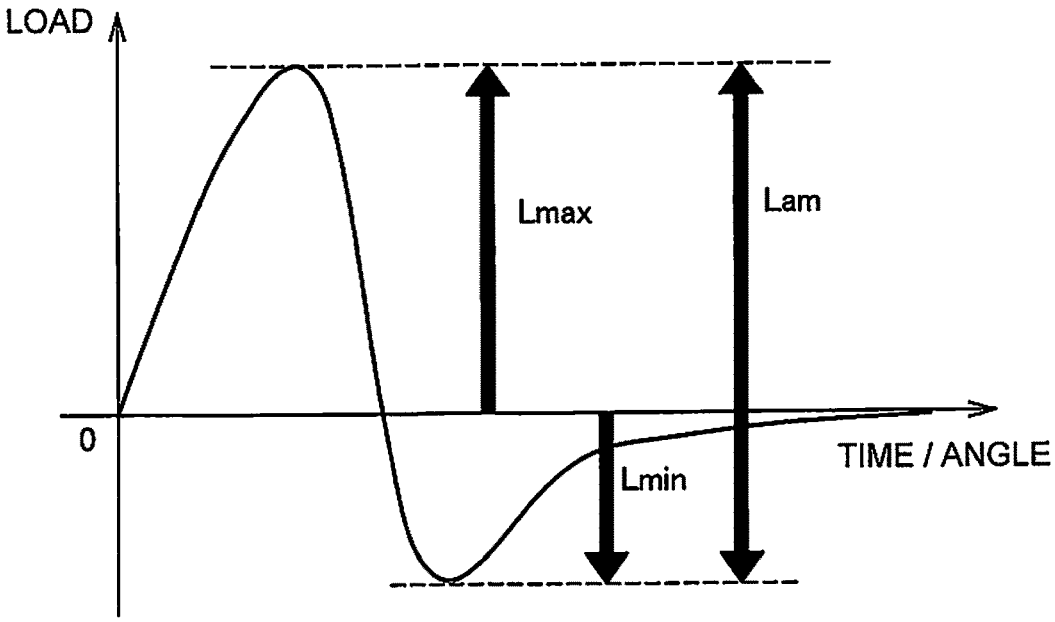
FIG. 11 illustrates changes in a slide load during pressing.

FIG. 11 illustrates changes in the slide load during pressing. When the "maximum value" is selected as the overload determination method, the overload determination is carried out by comparing a maximum load stored value Lmax with the first overload determination value. As discussed below, when the "minimum value" is selected as the overload determination method, the overload determination is carried out by comparing a minimum load stored value Lmin with a second overload determination value. When the "amplitude" is selected as the overload determination method, the overload determination is carried out by comparing a difference Lam between the maximum load stored value Lmax and the minimum load stored value Lmin with a third overload determination value.

In step S102, when the maximum value is not selected as an overload determination method, the process advances to step S105. In step S105, a determination is made as to whether the minimum value is selected as the overload determination method. When the minimum value is selected as the overload determination method, the process advances to step S106. In step S106, a determination is made as to whether an absolute value of the above-mentioned minimum load stored value is greater than an absolute value of the predetermined second overload determination value. When the absolute value of the above-mentioned minimum load stored value is greater than an absolute value of the predetermined second overload determination value, the process advances to step S107. Sudden stop processing is started in step S107. When the absolute value of the minimum load stored value is not greater than the absolute value of the predetermined second overload determination value, the process advances to the below-mentioned load lower limit determination processing.

In step S105, when the minimum value is not selected as the overload determination method, the process advances to step S108. In step S108, a determination is made as to whether the amplitude is selected as the overload determination method. When the amplitude is selected as the overload determination method, the process advances to step S109. In step S109, a determination is made as to whether the difference between the maximum load stored value and the minimum load stored value is greater than the predetermined third overload determination value. When the difference between the maximum load stored value and the minimum load stored value is greater than the predetermined third overload determination value, the process advances to step S110. Sudden stop processing is started in step S110. When the difference between the maximum load stored value and the minimum load stored value is not greater than the predetermined third overload determination value, the process advances to the below-mentioned load lower limit determination processing.

In the sudden stop processing in steps S104, S107, and S110, the drive control unit 34 promptly carries out processing to stop the slide 4.

The above-mentioned first to third overload determination values can be set to optional values with the emergency stop setting unit 29. As illustrated in FIG. 10, the setting screen includes an overload determination value input field E2. When the "maximum value" is selected in the selection field E1 of the overload determination method, the first overload determination value can be input into the input field E2. Similarly, when the "minimum value" is selected in the selection field E1 of the overload determination method, the second overload determination value can be input into the input field E2. When the "amplitude" is selected in the selection field E1 of the overload determination method, the third overload determination value can be input into the input field E2. The first to third overload determination values can be set to values different from each other.

Moreover, the overload determination values can be set for the slide left load, the slide right load, and the total load of the slide left load and the slide right load in the input field E2. The overload determination values of the slide left load, the slide right load, and the total load can be set to values different from each other.

Therefore, a determination is made in step S103 as to whether the maximum load stored values of the slide left load, the slide right load and the total load are greater than the first overload determination value. A determination is made in step S106 as to whether the absolute values of the minimum load stored values of the slide left load, the slide right load and the total load are greater than the second overload determination value. A determination is made in step S109 as to whether the differences between the maximum load stored values and the minimum load stored values of the slide left load, the slide right load and the total load are greater than the third overload determination value.

The sudden stop processing in steps S104, S107, or S110 is started when at least one of the slide left load, the slide right load, and the total load in any of steps S103, S106, and S109 is satisfied.

Figure 12:
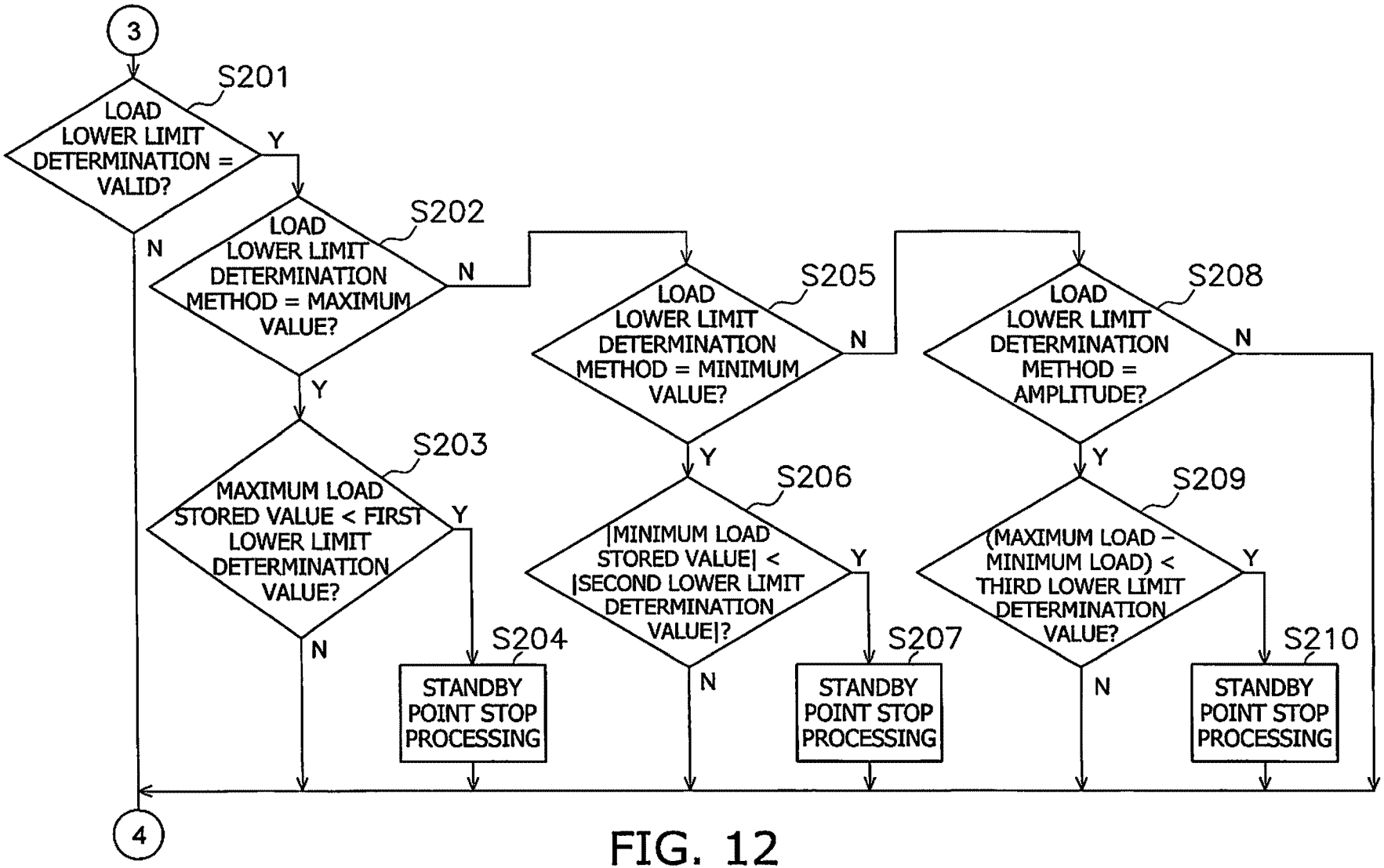
FIG. 12 is a flow chart illustrating processing of the load lower limit determination.

FIG. 12 is a flow chart illustrating processing of the load lower limit determination, and the processing is executed mainly by the load lower limit determination unit 33*b*. In step S201, a determination is made as to whether the load lower limit is valid or not. The operator is able to optionally set the load lower limit determination to valid or invalid with the above-mentioned emergency stop setting unit 29. When the load lower limit determination is set to valid, the process advances to step S202. When the overload determination is set to invalid, the process advances to the below-mentioned data display processing (see FIG. 14).

In step S202, a determination is made as to whether the maximum value is selected as the load lower limit determination method. When the maximum value is selected is selected as the load lower limit determination method, the process advances to step S203. In step S203, a determination is made as to whether the above-mentioned maximum load stored value is less than a predetermined first lower limit determination value. When the maximum load stored value is less than the predetermined first lower limit determination value, the process advances to step S204. Standby point stop processing is carried out in step S204. When the maximum load stored value is not less than the predetermined first lower limit determination value, the process advances to the below-mentioned data display processing.

Figure 13:
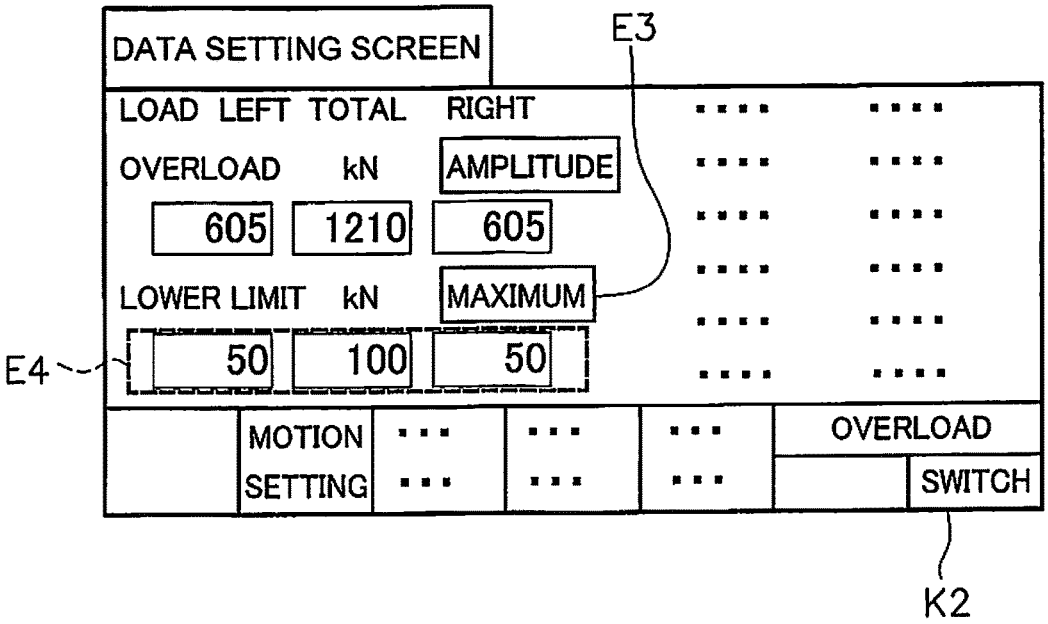
FIG. 13 is a view for illustrating an example of a setting screen for inputting determination data for load lower limit determination.

FIG. 13 illustrates an example of a setting screen for inputting determination data for the load lower limit determination with the emergency stop setting unit 29. As illustrated in FIG. 13, the setting screen includes a load lower limit determination method selection field E3. The operator is able to select "maximum value," "minimum value," or "amplitude" as the load lower limit determination method with the emergency stop setting unit 29. Specifically, the operator presses a switch key K2 on the setting screen to switch the load lower limit determination method selected in the selection field in order between the "maximum value," the "minimum value," and the "amplitude."

When the maximum value is not selected as the load lower limit determination method in step S202, the process advances to step S205. In step S205, a determination is made as to whether the minimum value is selected as the load lower limit determination method. When the minimum value is selected is selected as the load lower limit determination method, the process advances to step S206. In step S206, a determination is made as to whether the absolute value of the abovementioned minimum load stored value is less than an absolute value of a predetermined second lower limit determination value. When the absolute value of the minimum load stored value is less than the absolute value of the predetermined second lower limit determination value, the process advances to step S207. Standby point stop processing is carried out in step S207. When the absolute value of the minimum load stored value is not less than the absolute value of the predetermined second lower limit determination value, the process advances to the data display processing.

When the minimum value is not selected as the load lower limit determination method in step S205, the process advances to step S208. In step S208, a determination is made as to whether the amplitude is selected as the load lower limit determination method. When the amplitude is selected as the load lower limit determination method, the process advances to step S209. In step S209, a determination is made as to whether the difference between the maximum load stored value and the minimum load stored value is greater than a predetermined third lower limit determination value. When the difference between the maximum load stored value and the minimum load stored value is less than the predetermined third lower limit determination value, the process advances to step S210. Standby point stop processing is carried out in step S210. When the difference between the maximum load stored value and the minimum load stored value is not less than the predetermined third lower limit determination value, the process advances to the below-mentioned data display processing.

In the standby point stop processing in steps S204, S207, and S210, the drive control unit 34 does not promptly stop the slide 4 when the determination is made, but instead moves the slide 4 to a predetermined standby position and stops the slide 4. The predetermined standby position is, for example, the top dead center or a preset position near the top dead center. Alternatively, the predetermined standby position may be another position.

The above-mentioned first to third lower limit determination values can be set to optional values with the emergency stop setting unit 29. As illustrated in FIG. 13, the setting screen includes a load lower limit determination value input field E4. When the "maximum value" is selected in the selection field E3 of the load lower limit determination method, the first lower limit determination value can be input into the input field E4. Similarly, when the "minimum value" is selected in the selection field E3 of the load lower limit determination method, the second lower limit determination value can be input into the input field E4. When the "amplitude" is selected in the selection field E3 of the load overload determination method, the third lower limit determination value can be input into the input field E4. The first to third lower limit determination values can be set to values different from each other.

Moreover, the lower limit determination values can be set for the slide left load, the slide right load, and the total load of the slide left load and the slide right load in the input field E4. The lower limit determination values of the slide left load, the slide right load, and the total load may be set to values different from each other.

Therefore, the above-mentioned determination is made in step S203 as to whether the maximum load stored values of the slide left load, the slide right load and the total load are less than the first lower limit determination value. The determination is made in step S206 as to whether the absolute values of the minimum load stored values of the slide left load, the slide right load and the total load are less than the absolute value of the second lower limit determination value. A determination is made in step S209 as to whether the differences between the maximum load stored values and the minimum load stored values of the slide left load, the slide right load and the total load are less than the third lower limit determination value.

The standby point stop processing in steps S204, S207, or S210 is started when at least one of slide left load, the slide right load, and the total load in any of steps S203, S206, and S209 is satisfied.

Figure 14:
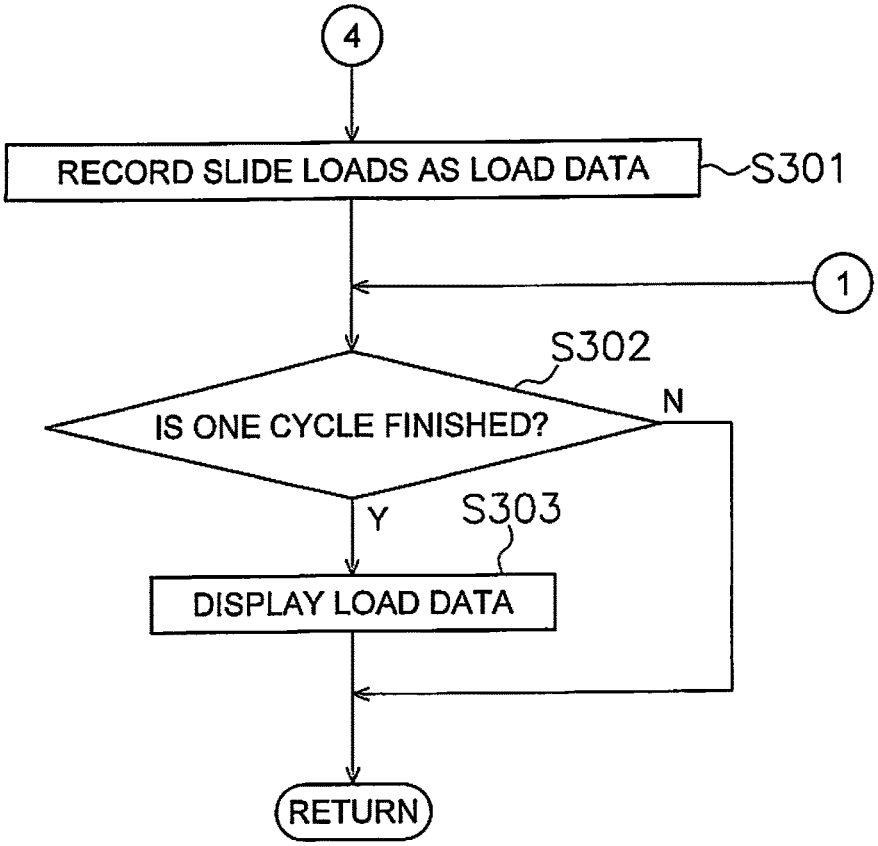
FIG. 14 is a flow chart depicting data display processing.

FIG. 14 is a flow chart depicting data display processing. In step S301, the load data recording unit 32 records the slide loads read in the abovementioned step S4 and step S5 in the storage device 31 as load data. As described above, the load data recording unit 32 detects the slide load during each predetermined sampling cycle time period and records the slide loads chronologically in the storage device 31. As a result, the load data recording unit 32 generates the load data.

In step S302, the load data recording unit 32 determines whether the pressing in one cycle is finished or not. When the pressing in one cycle is not finished, that is, if the pressing is in the middle of the one cycle, the process returns to step S1. When the pressing in the one cycle is finished, the process advances to step S303.

Figure 15:
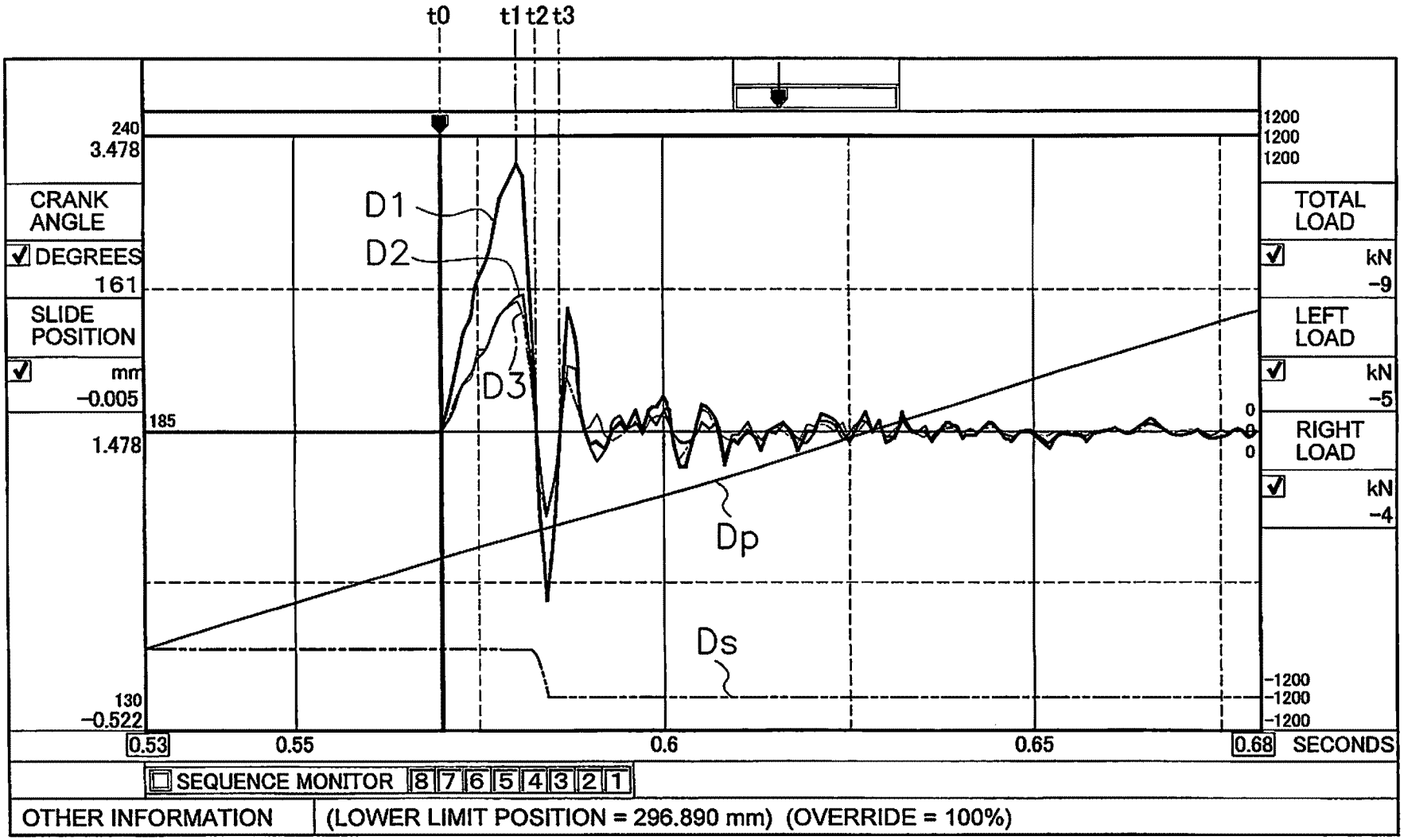
FIG. 15 illustrates an example of a display screen of load data.

In step S303, the load data is displayed. The load data output unit 35 inputs the command signals into the display 30 so that the display 30 displays the load data. FIG. 15 illustrates an example of a display screen of the load data.

The load data depicts temporal changes of the slide load and is represented as a waveform in the display 30. The load data includes total load data D1, slide left load data D2, and slide right load data D3. As illustrated in FIG. 15, the display screen also includes press angle data Dp and slide position data Ds in addition to the load data. The press angle data Dp depicts temporal changes of the press angle. The slide position data Ds depicts temporal changes of the slide position.

As illustrated in FIG. 15, a positive load is generated due to the upper die 6 coming into contact with the workpiece at the time t0, and the positive load reaches the maximum value at the time t1 in the total load data D1. A breakthrough is generated due to the upper die 6 punching out the workpiece at the time t1, and a negative load is generated from the time t2. Positive loads and negative loads are generated in an alternating manner from the time t3 and both the loads converge at 0 as time passes.

In this way, the total load data D1 is displayed as a waveform which indicates changes in the slide loads including positive loads and negative loads. Moreover, the slide left load data D2 and the slide right load data D3 are similarly displayed as waveforms which indicate changes in the slide loads including positive loads and negative loads.

A load including the negative load at the time of the breakthrough is detected in addition to the positive load from the pressing force of the slide 4 during the pressing in the control system 20 according to the present exemplary embodiment as described above. A determination is made to execute the emergency stop of the slide 4 on the basis of the positive load and the negative load. As a result, the occurrence of abnormalities brought about by the negative load at the time of the breakthrough can be suppressed.

The overload determination unit 33*a* determines to execute the emergency stop when the maximum load stored value of the positive load is greater than the first overload determination value. The overload determination unit 33*a* determines to execute the emergency stop when the absolute value of the minimum load stored value of the negative load is greater than the second overload determination value. Furthermore, the overload determination unit 33*a* determines to execute the emergency stop when the difference between the maximum load stored value of the positive load and the minimum load stored value of the negative load, namely the amplitude, is greater than the third overload determination value. As a result, the occurrence of abnormalities brought about by an excessive slide load can be suppressed.

When the emergency stop is executed in the overload determination, the drive control unit 34 promptly stops the slide 4 with the sudden stop processing. As a result, the occurrence of abnormalities can be stopped quickly. In particular, components may become damaged when the amount of the slide loads becomes excessive. Therefore, damage to the press machine 1 can be prevented by quickly stopping the slide 4.

The load lower limit determination unit 33*b* determines to execute the emergency stop when the maximum load stored value of the positive load is less than the first lower limit determination value. The load lower limit determination unit 33*b* determines to execute the emergency stop when the absolute value of the minimum load stored value of the negative load is less than the absolute value of the second lower limit determination value. The load lower limit determination unit 33*b* determines to execute the emergency stop when the difference between the maximum value of the positive load and the minimum value of the negative load, namely the amplitude, is less than the third lower limit determination value. As a result, the occurrence of abnormalities brought about by a slide load that is too small can be suppressed.

When the emergency stop is executed during the load lower limit determination, the drive control unit 34 moves the slide 4 to the predetermined standby position and stops the slide 4 with the standby point stop processing. As a result, the processing can be quickly restarted after inspecting for the presence or absence of an abnormality. In particular, the possibility that components become damaged is low when the amount of the slide load is too small. Therefore, a decrease in productivity can be suppressed by stopping the slide 4 after moving the slide 4 to the predetermined standby position instead of promptly stopping the slide 4 when the amount of the slide load is too small.

The slide load including the positive load and the negative load detected by the first load detector 27*a* and the second load detector 27*b* is displayed on the display 30. As a result, the operator is able to easily see whether a negative load is being generated during the breakthrough.

The display 30 displays the slide left load, the slide right load, and the total load for both the positive load and the negative load. As a result, the operator is able to understand the slide load more accurately.

The display 30 displays a waveform indicating changes in the slide loads including the positive loads and the negative loads. As a result, the operator is able to easily understand any changes in the slide loads while pressing the workpiece and at the time of the breakthrough.

Moreover, the operator is able to optionally set the target position, the speed, and the stoppage time period of the slide 4 with the motion setting unit 28. As a result, the generation of abnormalities at the time of the breakthrough can be suppressed. In particular, the operator changes the settings with the motion setting unit 28 while confirming the load data with the display 30, whereby the optimal settings for being able to suppress the generation of abnormalities at the time of the breakthrough can be easily found.

The detection value is corrected when the slide loads detected by the first load detector 27*a* and the second load detector 27*b* are negative loads. As a result, although suitable for detecting positive loads, sensors with a low precision for detecting negative loads can be used as the first load detector 27*a* and the second load detector 27*b*, and the determination of the emergency stop can be carried out with high precision.

Although an exemplary embodiment of the present invention has been described so far, the present invention is not limited to the above exemplary embodiments and various modifications may be made within the scope of the invention.

The configuration of the power transmission mechanism 10 or the configuration of the action conversion mechanism 11 of the press machine 1 are not limited to the above configurations of the exemplary embodiment and may be changed.

The correction of the detection values of the first load detector 27*a* and the second load detector 27*b* may be omitted. For example, when a sensor suited to detecting positive load and detecting negative loads is used as the first load detector 27*a* and the second load detector 27*b*, the correction of the detection values may be omitted.

The first load detector 27*a* and the second load detector 27*b* are not limited to strain gauges and may be another detection means. For example, the first load detector 27*a* and the second load detector 27*b* may be piezoelectric sensors. Alternatively, the first load detector 27*a* and the second load detector 27*b* may be laser measuring devices that measure the displacement of the main body frame 2 due to the slide loads.

The number of load detectors is not limited to two as in the first load detector 27*a* and the second load detector 27*b* of the above exemplary embodiment. The number of load detectors may be one or may be three or more.

The driving means of the slide 4 is not limited to the electric servomotor 9 and may be changed. For example, the driving means of the slide 4 may be a hydraulic motor.

While the slide left load, the slide right load, and the total load are detected as the slide load in the above exemplar embodiment, a portion of the detection of the above loads may be omitted. Alternatively, the slide load of portions different from the above portions may be detected. For example, the load of a middle part of the slide 4 may be detected.

The display form of the slide loads on the display 30 is not limited to a waveform and may be changed. For example, the slide loads may be displayed as numerical values. In this case, the above-mentioned maximum load stored value and the minimum load stored value are preferably displayed on the display 30. Moreover, the maximum load stored values and the minimum load stored values for each of the slide left load, the slide right load, and the total load are preferably displayed on the display 30.

The motion setting unit 28 may be a device for inputting the above-mentioned motion data and is not limited to software keys. For example, the motion setting unit 28 may be a hardware key or switch provided separately from the display 30. The emergency stop setting unit 29 may also be a device for inputting the above-mentioned determination data, and is not limited to software keys. For example, the emergency stop setting unit 29 may be a hardware key or switch provided separately from the display 30.

Alternatively, the motion setting unit 28 may receive the motion data through communication from a control device provided outside of the control system of the press machine 1. The emergency stop setting unit 29 may also receive the determination data through communication from a control device provided outside of the control system of the press machine 1.

While the maximum load stored value and the minimum load stored value are reset for each one cycle in the above exemplary embodiment, the maximum load stored value and the minimum load stored value may be reset for each of a predetermined number of cycles. Alternatively, the load data may be displayed on a display for each of a predetermined number of cycles. That is, the waveform of the load data of the above exemplary embodiment is not limited to one cycle and may be updated and displayed on the display 30 for each of the predetermined number of cycles.

According to the exemplary embodiments of the present invention, the occurrence of abnormalities brought about by the negative load at the time of the breakthrough can be suppressed.

What is claimed is:

1. A control system for a press machine which raises and lowers a slide to perform pressing, the control system comprising:

a load detector arranged to detect a load of the slide including a positive load due to a pressing force of the slide during pressing and a negative load occurring at a breakthrough, the negative load being oriented in a direction opposite a direction of the positive load; and a controller arranged to receive a detection signal from the load detector indicating the positive load and the negative load, the controller being configured perform an emergency stop determination to determine whether to execute an emergency stop of the slide based on the positive load and the negative load, the controller using a correction coefficient to obtain a corrected detection value of the load and determining whether to execute the emergency stop based on the corrected detection value when the load detected by the load detector is a negative load, and the controller being configured to control driving of the slide based on a determination result of the emergency stop determination.

2. The control system for a press machine according to claim 1, wherein the controller performing the emergency stop determination by performing an overload determination in which the controller decides to execute the emergency stop when a maximum value of the positive load is greater than a predetermined first overload determination value.

3. A control system for a press machine which raises and lowers a slide to perform pressing, the control system comprising:

a load detector arranged to detect a load of the slide including a positive load due to a pressing force of the slide during pressing and a negative load occurring at a breakthrough, the negative load being oriented in a direction opposite a direction of the positive load; and a controller arranged to receive a detection signal from the load detector indicating the positive load and the negative load, the controller being configured perform an emergency stop determination to determine whether to execute an emergency stop of the slide based on the positive load and the negative load, the controller performing the emergency stop determination by performing an overload determination in which the controller decides to execute the emergency stop when an absolute value of a minimum value of the negative load is greater than a predetermined second overload determination value, and the controller being configured to control driving of the slide based on a determination result of the emergency stop determination.

4. A control system for a press machine which raises and lowers a slide to perform pressing, the control system comprising:

a load detector arranged to detect a load of the slide including a positive load due to a pressing force of the slide during pressing and a negative load occurring at a breakthrough, the negative load being oriented in a direction opposite a direction of the positive load; and a controller arranged to receive a detection signal from the load detector indicating the positive load and the negative load, the controller being configured perform an emergency stop determination to determine whether to execute an emergency stop of the slide based on the positive load and the negative load, the controller performing the emergency stop determination by performing an overload determination in which the controller decides to execute the emergency stop when a difference between a maximum value of the positive load and a minimum value of the negative load is greater than a predetermined third overload determination value, and the controller being configured to control driving of the slide based on a determination result of the emergency stop determination.

5. The control system for a press machine according to claim 2, wherein the controller promptly stops the slide when the controller decides to execute the emergency stop in the overload determination.

6. The control system for a press machine according to claim 1, wherein the controller performing the emergency stop determination by performing a load lower limit determination in which the controller decides to execute the emergency stop when a maximum value of the positive load is less than a predetermined first lower limit determination value.

7. A control system for a press machine which raises and lowers a slide to perform pressing, the control system comprising:

a load detector arranged to detect a load of the slide including a positive load due to a pressing force of the slide during pressing and a negative load occurring at a breakthrough, the negative load being oriented in a direction opposite a direction of the positive load; and a controller arranged to receive a detection signal from the load detector indicating the positive load and the negative load, the controller being configured perform an emergency stop determination to determine whether to execute an emergency stop of the slide based on the positive load and the negative load, the controller performing the emergency stop determination by performing a load lower limit determination in which the controller decides to execute the emergency stop when an absolute value of a minimum value of the negative load is less than an absolute value of a predetermined second lower limit determination value, the controller being configured to control driving of the slide based on a determination result of the emergency stop determination.

8. A control system for a press machine which raises and lowers a slide to perform pressing, the control system comprising:

a load detector arranged to detect a load of the slide including a positive load due to a pressing force of the slide during pressing and a negative load occurring at a breakthrough, the negative load being oriented in a direction opposite a direction of the positive load; and a controller arranged to receive a detection signal from the load detector indicating the positive load and the negative load, the controller being configured perform an emergency stop determination to determine whether to execute an emergency stop of the slide based on the positive load and the negative load, the controller performing the emergency stop determination by performing a load lower limit determination in which the controller decides to execute the emergency stop when a difference between a maximum value of the positive load and a minimum value of the negative load is less than a predetermined third lower limit determination value, the controller being configured to control driving of the slide based on a determination result of the emergency stop determination.

9. The control system for a press machine according to claim 6, wherein the controller moves the slide to a predetermined standby position and stops the slide when the controller executes the emergency stop in the load lower limit determination.

10. The control system for a press machine according to claim 1, further comprising a display configured to display the positive load and the negative load detected by the load detector.

11. The control system for a press machine according to claim 10, wherein the load detector includes a first load detector arranged to detect a left load on a left side of the slide and a second load detector arranged to detect a right load on a right side of the slide, and the display displays the left and right loads and a total of the left and right loads.

12. The control system for a press machine according to claim 10, wherein the display displays a waveform indicating changes in the loads of the slide including the positive load and the negative load.

13. The control system for a press machine according to claim 1, wherein the controller is configured to receive motion setting data from an input device for setting a target position of the slide, a speed of the slide, and a stoppage time of the slide at the target position.

14. A press machine comprising:

a main body frame;

a slide supported on the main body frame, the slide being movable in up and down directions;

a drive mechanism configured to raise and lower the slide, and the control system according to claim 1.

15. A control method for a press machine which performs pressing by raising and lowering a slide, the method comprising:

a load detection step for detecting a load of the slide including a positive load due to a pressing force of the slide during pressing and a negative load at a breakthrough, the negative load being oriented in a direction opposite a direction of the positive load;

a determination step for determining whether to execute an emergency stop of the slide based on the positive load and the negative load detected in the load detection step;

a correction step for using a correction coefficient to obtain a corrected detection value of the load and determining whether to execute the emergency stop based on the corrected detection value when the load detected by the load detector is a negative load; and a drive control step for controlling driving of the slide based on a determination result from the determination step.

16. The control system for a press machine according to claim 7, wherein the controller moves the slide to a predetermined standby position and stops the slide when the controller executes the emergency stop in the load lower limit determination.

17. The control system for a press machine according to claim 8, wherein the controller moves the slide to a predetermined standby position and stops the slide when the controller executes the emergency stop in the load lower limit determination.

* * * * *